US007699549B2

(12) United States Patent
Dochi et al.

(10) Patent No.: US 7,699,549 B2
(45) Date of Patent: Apr. 20, 2010

(54) INK RIBBON CARTRIDGE

(75) Inventors: Kiyotaka Dochi, Kanagawa (JP); Hitoshi Kamoda, Kanagawa (JP)

(73) Assignee: Sony Corporation, Tokyo (JP)

( * ) Notice: Subject to any disclaimer, the term of this patent is extended or adjusted under 35 U.S.C. 154(b) by 230 days.

(21) Appl. No.: 11/534,729

(22) Filed: Sep. 25, 2006

(65) Prior Publication Data

US 2007/0077107 A1 Apr. 5, 2007

(30) Foreign Application Priority Data

Sep. 30, 2005 (JP) ..... P2005-288795

(51) Int. Cl.
*B41J 35/28* (2006.01)

(52) U.S. Cl. ..... 400/208.1; 400/208

(58) Field of Classification Search ..... 400/208.1, 400/208

See application file for complete search history.

(56) References Cited

U.S. PATENT DOCUMENTS 4,413,919 A * 11/1983 Applegate et al. ..... 400/208
4,414,496 A * 11/1983 Watanabe et al. ..... 318/696
4,616,945 A * 10/1986 Komplin ..... 400/697.1
4,662,766 A * 5/1987 Teichmann et al. ..... 400/208
4,914,525 A * 4/1990 Abe et al. ..... 358/498
5,385,416 A * 1/1995 Maekawa et al. ..... 400/208
5,595,447 A * 1/1997 Takayama et al. ..... 400/231
6,126,344 A * 10/2000 Takayama et al. ..... 400/615.2
6,457,885 B1 * 10/2002 Yamamoto et al. ..... 400/207
RE39,169 E * 7/2006 Kameyama et al. ..... 400/208
2004/0136766 A1 * 7/2004 Hayashi ..... 400/242
2005/0201805 A1 * 9/2005 Yamamoto ..... 400/208

FOREIGN PATENT DOCUMENTS

CN 1313198 9/2001

(Continued)

OTHER PUBLICATIONS

European Search Report dated Feb. 13, 2007.

(Continued)

*Primary Examiner*—Anthony H. Nguyen
(74) *Attorney, Agent, or Firm*—Sonnenschein Nath & Rosenthal LLP

(57) ABSTRACT

An ink ribbon cartridge includes spools each including a ratchet gear in one end portion. A cartridge body includes integrally formed resilient engagement pieces each including a ratchet portion that engages and disengages the ratchet gear of the respective spool and a compressed portion that is compressed by a compressing portion of a thermal transfer printer apparatus. When the ink ribbon cartridge is installed in the thermal transfer printer apparatus, the resilient engagement pieces behave such that the compressed portions are compressed by the compressing portions of the thermal transfer printer apparatus. Thereby, engagement between the ratchet gears of the respective spools and the ratchet portions is released, and the spools become rotatable in the cartridge body.

5 Claims, 5 Drawing Sheets

FOREIGN PATENT DOCUMENTS

| | | | |
|---|---|---|---|
| EP | 0 078 369 | | 5/1983 |
| EP | 0 435 108 | | 7/1991 |
| EP | 0 958 931 | | 11/1999 |
| JP | 1983-076290 | | 5/1983 |
| JP | HEI 03-66757 | U | 6/1991 |
| JP | HEI 05-039961 | U | 5/1993 |
| JP | 1995-052487 | | 2/1995 |
| JP | 08-244322 | | 9/1996 |
| JP | HEI 09-109500 | A | 4/1997 |
| JP | 11-115267 | | 4/1999 |
| JP | 1994-122264 | | 11/2009 |

OTHER PUBLICATIONS

Office Action for Japanese Application No. 2005-288795 dated Aug. 21, 2009.

Japanese Patent Office, Office Action issued in Patent Application JP 2005-288795, on Nov. 24, 2009.

* cited by examiner

INK RIBBON CARTRIDGE

CROSS REFERENCES TO RELATED APPLICATIONS

The present invention contains subject matter related to Japanese Patent Application JP 2005-288795 filed in the Japanese Patent Office on Sep. 30, 2005, the entire contents of which being incorporated herein by reference.

BACKGROUND OF THE INVENTION

1. Field of the Invention

The present invention relates to an ink ribbon cartridge that prevents reverse rotation of spools that hold an ink ribbon wound thereabout.

2. Description of the Related Art

Thermal transfer printer apparatuses use an ink ribbon cartridge. An ink ribbon cartridge containing an ink ribbon is installed in a thermal transfer printer apparatus, in which the ink ribbon and printing paper are driven to travel between a thermal head and a platen roller provided in a position opposite to the thermal head. In addition, thermal energy is applied by the thermal head to the ink ribbon, and dies of the ink ribbon are thermally transferred, whereby an image is printed on the printing paper. An ink ribbon cartridge used by being installed in a thermal transfer printer apparatus, such as described above, includes an ink ribbon that includes respective ink layers of colors, such as yellow, magenta, and cyan, that are juxtaposed to one another in a travel direction. The ink ribbon is wounded on a pair of spools, namely, a supply spool and a take-up spool, and the pair of spools holding the wounded ink ribbon are rotatably housed in a cartridge body. Such the ink ribbon cartridge includes a non-reversing mechanism to prevent reverse rotation of one or both of the spools during, for example, transportation or storage.

For example, Japanese Unexamined Patent Application Publication No. 08-244322 ("Patent Publication 1," hereafter) discloses an ink ribbon cartridge that includes a ratchet gear in one end portion of a spool that holds an ink ribbon wound thereabout, and pawls that engages the ratchet gear in the event of reverse rotation. However, in the ink ribbon cartridge described in Patent Publication 1, during forward rotation of the spool for printing, there occurs operational noise, i.e., vibration noise, of the pawls riding over gear teeth of the ratchet gear. According to description of Patent Publication 1, an adhesive made of, for example, a plastic film is provided to prevent the operational noise. With the adhesive used, while the operational noise can be restrained from occurring, the number of components/parts is increased thereby, such that an assembly step become complex.

In addition, Japanese Unexamined Patent Application Publication No. 11-115267 ("Patent Publication 2," hereafter) discloses an ink ribbon cartridge that includes pawls for engagement with a ratchet gear of a spool. However, similar to the above, also in the ink ribbon cartridge described in Patent Publication 2, during forward rotation of a spool for printing, there occurs operational noise, i.e., vibration noise, of the pawls riding over gear teeth of the ratchet gear. Further, in the ink ribbon cartridge disclosed in patent publication 2, the pawls are separate members from the body of the cartridge, the number of components/parts is increased thereby, such that an assembly step become complex.

Further, there are ink ribbon cartridges of another including irregular portions provided on an end face of the spool. In this case, the irregular portions of the spool end face are urged by a leaf spring or the like provided in the cartridge body to engage irregular portions on an opposite face of the cartridge body, thereby to prevent rotation of the spool. In the ink ribbon cartridge also, since the leaf spring is used, the number of components/parts cannot be reduced.

SUMMARY OF THE INVENTION

The present invention is made in view of situations and problems such as described above, and it is desirous to provide an ink ribbon cartridge that, while reducing the number of components/parts, is capable of preventing reverse rotation of a spool and is further capable of preventing occurrence of operational noise.

An ink ribbon cartridge according to an embodiment of the present invention includes a pair of spools for holding an ink ribbon wound thereabout, the pair of spools being a supply spool and a take-up spool, and a cartridge body in which the pair of spools are housed to be rotatable and apart from one another. The pair of spools each include a ratchet gear in a portion of one end of the respective spool. The cartridge body includes a pair of resilient engagement pieces integrally formed and each including, on an end side, a ratchet portion that engages and disengages the ratchet gear of the respective spool, and a compressed portion that is compressed by a compressing portion on the side of a thermal transfer printer apparatus. When the ink ribbon cartridge is installed in the thermal transfer printer apparatus, the pair of resilient engagement pieces behave such that the compressed portions are compressed by the compressing portions of the thermal transfer printer apparatus. Thereby, engagement between the ratchet gears of the pair of spools and the ratchet portions is released, and the pair of spools become rotatable in the cartridge body.

According to the embodiment of the present invention, the resilient engagement pieces for engagement with the ratchet gear of the spools are thus formed integrally with the cartridge body. Consequently, the number of components/parts of the non-reversing mechanism for preventing reverse rotation of the spools can be reduced, and hence the assembly step can be simplified.

Further, the respective resilient engagement pieces are in non-engagement with the ratchet gear of the spools even in use, operational noise can be eliminated.

BRIEF DESCRIPTION OF THE DRAWINGS

Embodiments of the present invention will be described in detail based on the following figures, wherein.

DETAILED DESCRIPTION OF THE PREFERRED EMBODIMENTS

An ink ribbon cartridge 1 employing an embodiment of the present invention will be described herebelow with reference to the accompanying drawings.

Figure 1:
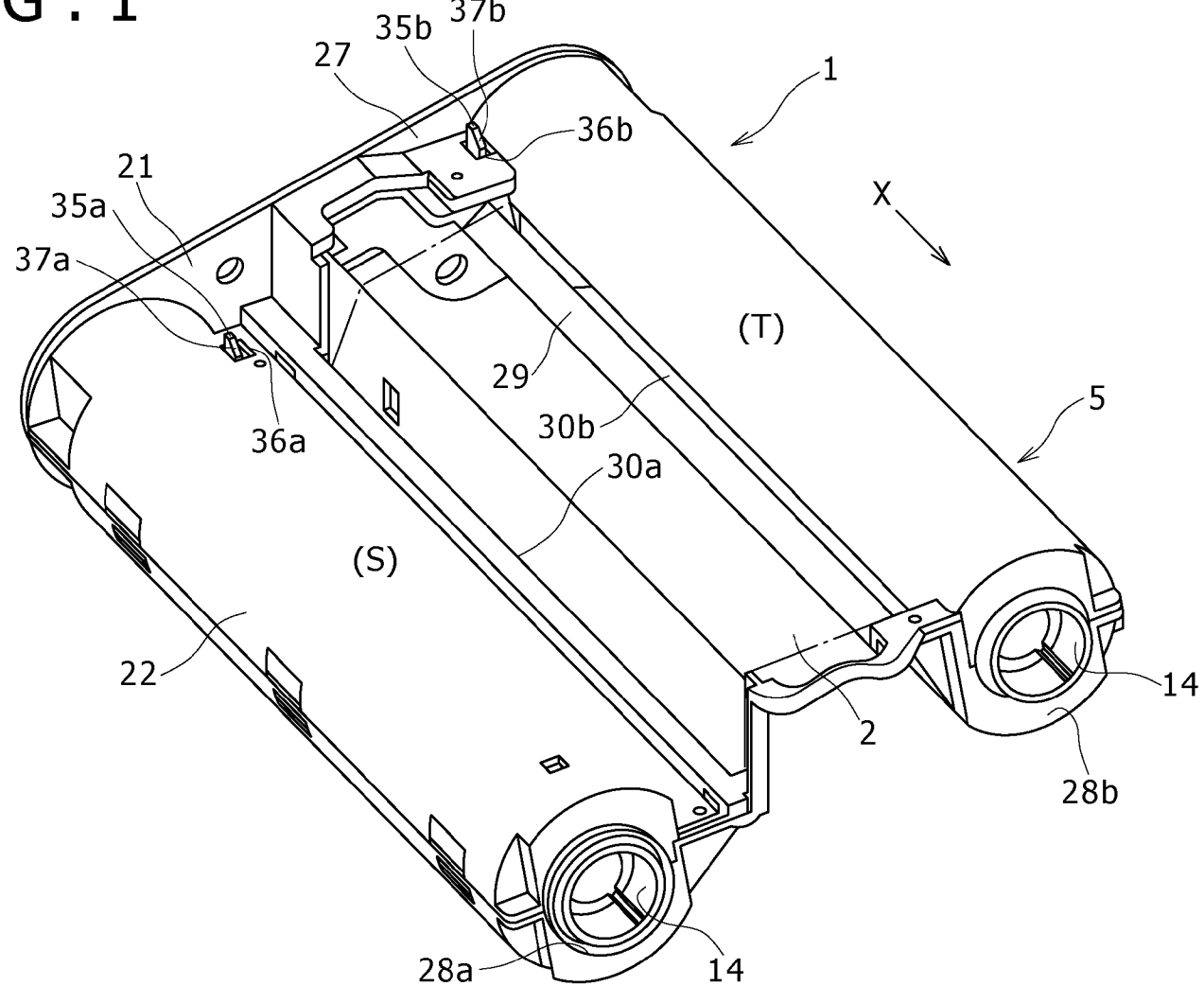
FIG. 1 is a perspective view of an ink ribbon cartridge employing an embodiment of the present invention, as viewed from the side of a lower shell.
Figure 2:
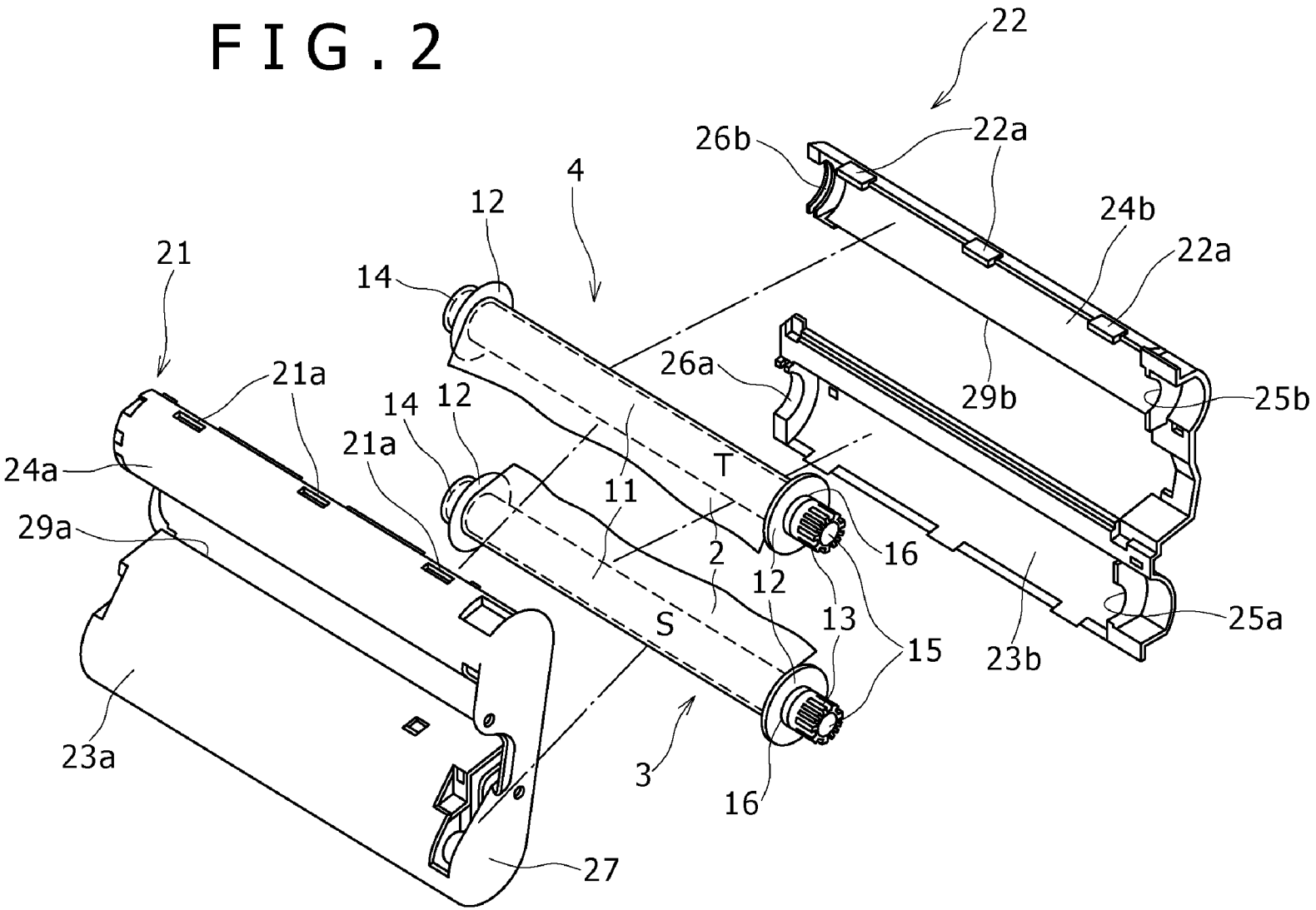
FIG. 2 is an exploded perspective view of the ink ribbon cartridge.

Referring to FIG. 1, the ink ribbon cartridge 1 employing an embodiment of the present invention is attached to a thermal transfer printer apparatus that thermally transfer dyes onto a printing paper to thereby perform color printing onto the printing paper. With reference to FIGS. 1 and 2, the ink ribbon cartridge 1 includes a supply spool 3, a take-up spool 4, and a cartridge body 5. The supply spool 3 holds an ink ribbon 2 wound thereabout, in which the ink ribbon 2 includes dye layers to be transferred onto the printing paper. The take-up spool 4 takes-up the ink ribbon 2. The cartridge body 5 houses the supply and take-up spools 3 and 4 that, respectively, hold ink ribbon 2 wound thereabout.

More specifically, the ink ribbon 2 has yellow (Y), magenta (M), and cyan (C) ink layers respectively formed of sublimable and thermally diffusible dies. These dyes are repetitiously series coated in the travel direction at a fixed distance on one major surface formed of a base sheet formed of a plastic film. The ink ribbon 2 is used in the manner that a series of yellow (Y), magenta (M), and cyan (C) ink layers is used to print one image. The ink ribbon 2, as described above, is housed in the cartridge in such a manner that a portion of one end of the ink ribbon 2 is anchored to the supply spool 3 and a portion of the other end of the ink ribbon 2 is anchored to the take-up spool 4. As printing progresses, the ink ribbon 2 is progressively supplied from the supply spool 3 and taken-up on the take-up spool 4.

Figure 3:
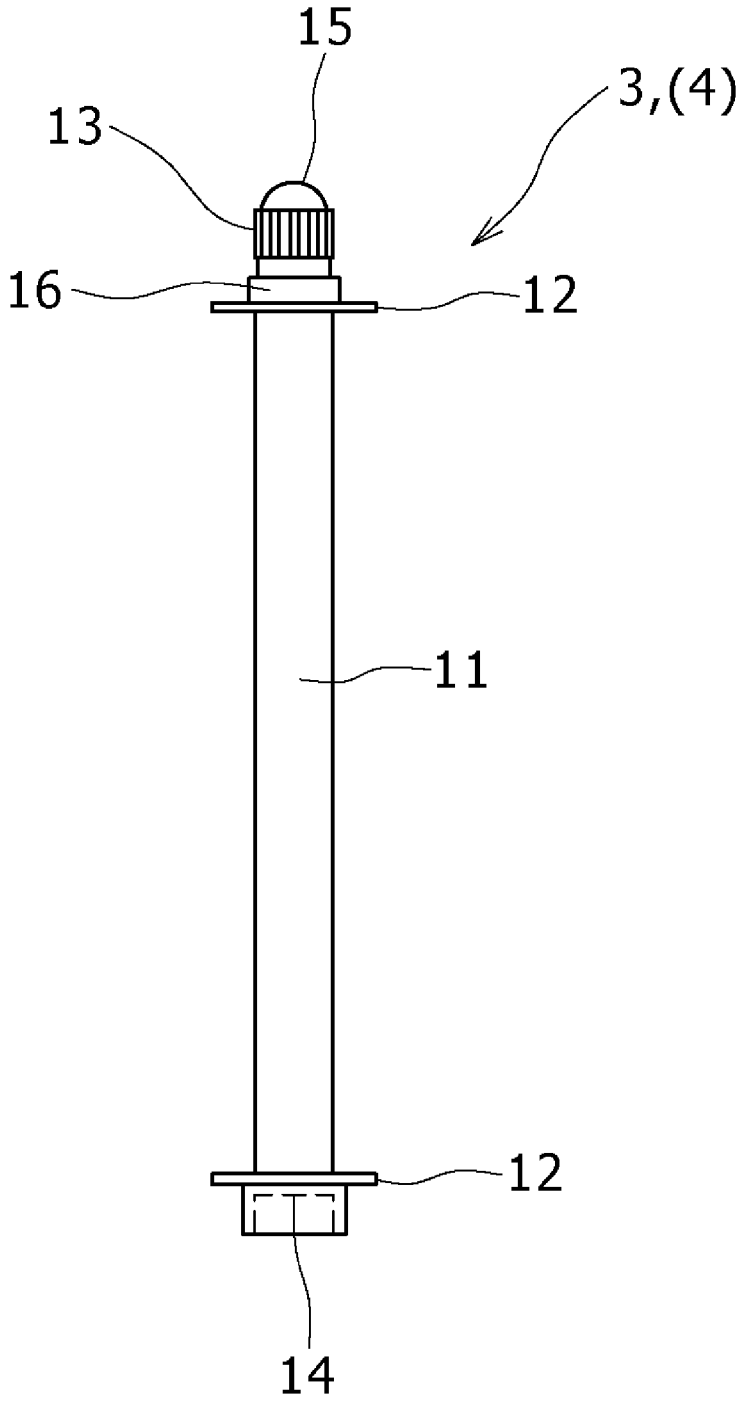
FIG. 3 is a plan view of a supply spool (or, take-up spool) used in the ink ribbon cartridge.

As shown in FIGS. 2 and 3, the supply and take-up spools 3 and 4 each have a spindle portion 11 about which the ink ribbon 2 is wound, and flange portions 12 are individually provided on two sides of the spindle portion 11. A portion of one end of the ink ribbon 2 is anchored to the spindle portion 11 of the supply spool 3 by using an adhesive or anchoring member, a portion of the other end of the ink ribbon 2 is anchored to the spindle portion 11 of the take-up spool 4 by using the adhesive or anchoring member. The flange portions 12 define winding positions in the width direction of the ink ribbon 2 that is to be wound on the spindle portion 11, and concurrently, define the position in the axial direction. In a portion of one end of the respective spindle portion 11, a ratchet gear 13 is provided to an outer portion of the flange portion 12 via the base portion 16 not having a gear portion. In a portion of the other end of the respective spindle portion 11, a driving opening 14 for engagement with a drive shaft of the thermal transfer printer apparatus is provided to an outer portion of the flange portion 12. Further, the supply and take-up spools 3 and 4 each have a protrusion portion 15 in a portion of the end on the side having the ratchet gear 13. The protrusion portion 15 has an end having, for example, an arcuate face. When the drive shafts on the respective supply and take-up sides of the thermal transfer printer apparatus engage the respective driving openings 14, the protrusion portions 15 are compressed by, for example, spring forces on the drive shaft sides, thereby serving as portion that are abutted against base walls of the cartridge body 5. The respective protrusion portion 15 thus having the arcuate face reduces friction with the base wall.

Figure 4B:
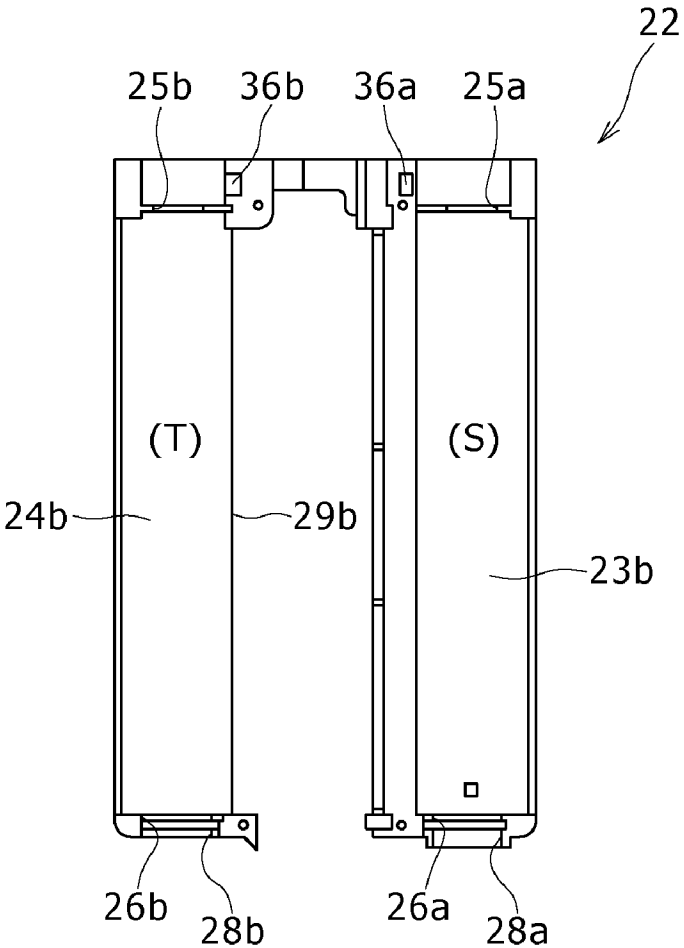
FIG. 4B is a plan view of the lower shell as viewed from the inner side.
Figure 4A:
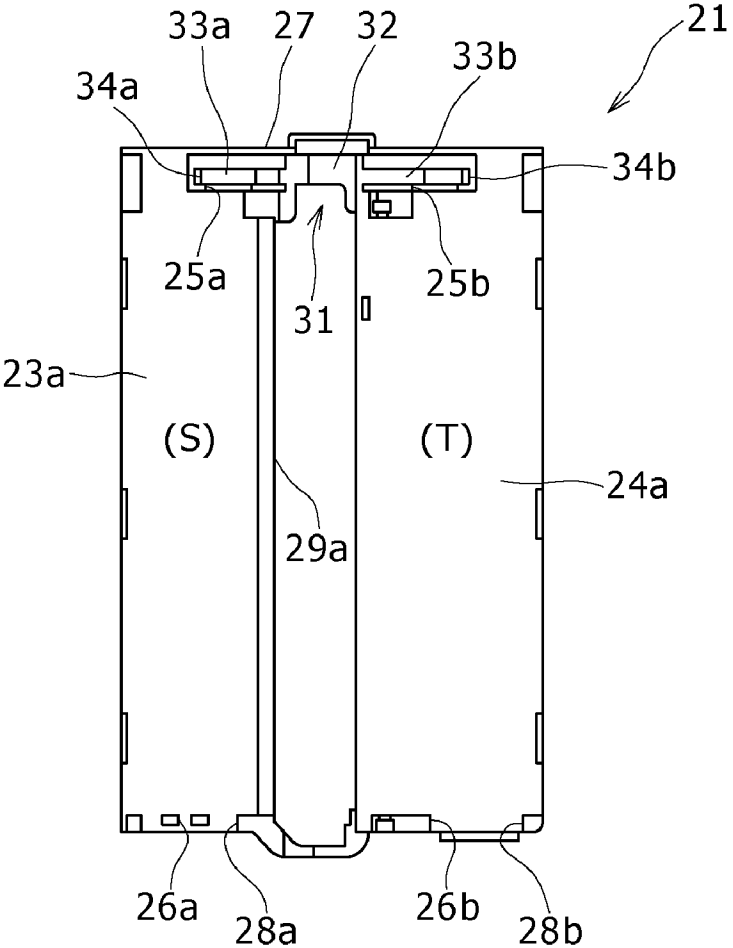
FIG. 4A is a plan view of an upper shell as viewed from the inner side.

With reference to FIGS. 2, 4A and 4B, the cartridge body 5 for rotatably housing the supply and take-up spools 3 and 4 is configured by coupling upper and lower shells 21 and 22 together. The upper and lower shells 21 and 22, respectively, include supply spool housing portions 23*a* and 23*b* for housing the supply spool 3, and take-up spool housing portions 24*a* and 24*b* for housing the take-up spool 4. The spool and take-up housing portions 23*a* and 23*b* and 24*a* and 24*b* are each formed to have a semicircular cross section. In the states of the upper and lower shells 21 and 22 coupled together, the supply spool housing portions 23*a* and 23*b* together form a shape having substantially a circular cross section, thereby to rotatably house the supply spool 3. The take-up spool housing portions 24*a* and 24*b* together form a shape having substantially a circular cross section, thereby to rotatably house the take-up spool 4.

Bearing portions 25*a* and 25*b*, respectively, for supporting the base portions 16 on the sides of the ratchet gears 13 of the supply and take-up spools 3 and 4 are formed on portions of one ends of the supply and take-up spool housing portions 23*a* and 24*a* of the upper and lower shells 21 and 22. In addition, bearing portions 26*a* and 26*b*, respectively, for supporting other-end sides, on which the driving openings 14 of the supply and take-up spools 3 and 4 are provided, externally of the flange portions 12 are formed on the other-end sides of the spool and take-up spool housing portions 23*a* and 24*a*. Referring back to FIG. 1, the cartridge body 5 is configured to include driving openings 28*a* and 28*b* on the side of the other end that respectively expose the driving openings 14 of the supply and take-up spools 3 and 4 to the outside in the state where the upper and lower shells 21 and 22 are coupled together. The other end of the cartridge body 5 is used as an end of insertion into the thermal transfer printer apparatus. In the event that the cartridge body 5 is inserted into the thermal transfer printer apparatus, the drive shafts are engaged with the driving openings 14 of the supply and take-up spools 3 and 4 that are exposed to the outside through the driving openings 28*a* and 28*b*. Thereby, the drive shafts rotate the respective supply and take-up spools 3 and 4 in the thermal transfer printer apparatus.

Further, with reference to FIGS. 2 and 4A, a sidewall 27 of the cartridge body 5 is provided in the portion of one end of the upper shell 21. The sidewall 27 is spaced apart from the bearing portions 25*a* and 25*b* on the side of one end of the upper shell 21. The supply and take-up spools 3 and 4 are fitted with predetermined amounts of axial backlash (in the axial direction) when rotatably supported by the bearing portions 25*a* and 25*b* and 26*a* and 26*b*. When the ink ribbon cartridge 1 is installed in the thermal transfer printer apparatus, the supply and take-up spools 3 and 4 are compressed toward the sidewall 27 of the upper shell 21 by spring forces of the drive shafts engaged with the driving openings 14, whereby the axial backlash of the supply and take-up spools 3 and 4 is eliminated. More specifically, the protrusion portions 15 on the sides of the ratchet gears 13 of the supply and take-up spools 3 and 4 abut on an inner face of the sidewall 27, whereby the axial backlash is eliminated and the supply and take-up spools 3 and 4 are positioned in the axial direction. Thus, the inner face of the sidewall 27 is abutted by the protrusion portions 15 on the sides of the ratchet gears 13 of the supply and take-up spools 3, the supply and take-up spools 3 and 4 can be positioned along the axial direction.

Opening portions 29*a* and 29*b* (alternatively simply "opening portion 29," hereafter) are formed between the supply and take-up spool housing portions 23*a* and 23*b* and 24*a* and 24*b*. When the upper and lower shells 21 and 22 are coupled together, the opening portion 29, which has the opening portions 29*a* and 29*b*, is extended through the supply and take-up spools 3 and 4. Thereby, the opening portion 29 works as a region allowing extension of the ink ribbon 2 exposed to the outside from respective slits 30*a* and 30*b* of the supply and take-up spool housing portions 23*a* and 23*b* and 24*a* and 24*b*. Concurrently, the opening portion 29 works as a region that allows the thermal head of the thermal transfer printer apparatus and to compress the ink ribbon 2 onto the printing paper.

The upper and lower shells 21 and 22 are coupled together in the manner that anchoring openings 21*a* formed in lateral edge portions of the upper shell 21 are anchored to anchoring pieces 22*a* formed in lateral edge portions of the lower shell 22. Alternatively, the upper and lower shells 21 and 22 can be coupled together by, for example, ultrasonic welding or thermal welding or using an adhesive.

Figure 5:
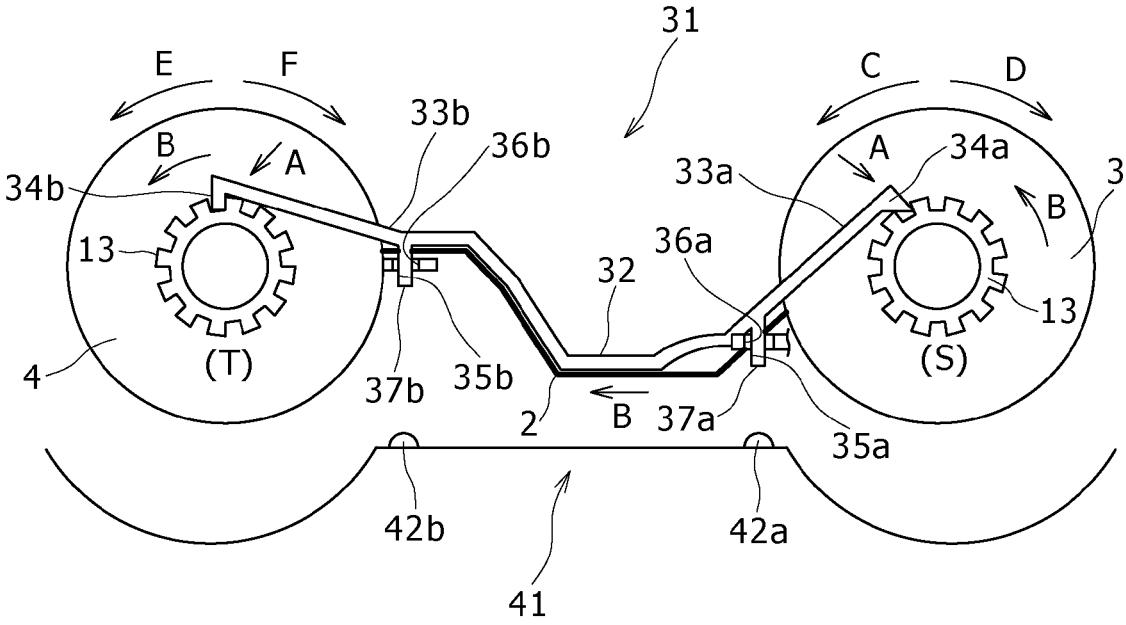
FIG. 5 is a front view of an anti-rotation mechanism of the ink ribbon cartridge.

With reference to FIGS. 4(A) and 5, a non-reversing mechanism 31 for preventing reverse rotation of the rotatably housed supply and take-up spools 3 and 4 is provided on the side of one end provided with the sidewall 27 in the upper shell 21 constituting the cartridge body 5. The non-reversing mechanism 31 is integral with a coupling portion 32 and has a pair of resilient engagement pieces 33*a* and 33*b* that are integral with the coupling portion 32 provided between the spool and take-up spool housing portions 23*a* and 24*a* and that extend from the coupling portion 32 to the spool and take-up spool housing portions 23*a* and 24*a*. The respective resilient engagement pieces 33*a* and 33*b* have, on the sides of ends, protrusive ratchet portions 34*a* and 34*b* for engagement with the ratchet gears 13 of the supply and take-up spools 3 and 4. The ratchet portions 34*a* and 34*b*, respectively, are displaceable along the direction of an arrowed A (shown in FIG. 5) or and a counter-A direction (shown in FIG. 5) from base end portions of the coupling portion 32. In this case, the base end portions correspond to resilience origins for engagement and disengagement with the ratchet gears 13 of the supply and take-up spools 3 and 4.

Further, the resilient engagement pieces 33*a* and 33*b*, respectively, have compressed portions 35*a* and 35*b*, between the ratchet portions 34*a* and 34*b* and the resilience origins. The compressed portions 35*a* and 35*b* are compressed by compressing portions 42*a* and 42*b* that is provided to an insertion guide member 41 of the thermal transfer printer apparatus for the ink ribbon cartridge 1 to protrude to the side of the lower shell 22. With reference to FIGS. 4B and 5, when the ratchet portions 34*a* and 34*b* are in engagement with the ratchet gears 13, the compressed portions 35*a* and 35*b*, which protrude from the resilient engagement pieces 33*a* and 33*b*, extend externally of through-holes 36*a* and 36*b* formed on the on the side of one end of the lower shell 22. Thereby, the compressed portions 35*a* and 35*b* become compressible by the compressing portions 42*a* and 42*b* of the insertion guide member 41 on the side of the thermal transfer printer apparatus. For the sake of description, FIG. 5 shows the state that the cartridge body 5 and the insertion guide member 41 are spaced apart from one another. Actually, however, the cartridge body 5 and the insertion guide member 41 are close to one another for guiding insertion of the cartridge body 5. Further, as shown in FIG. 1, in the compressed portions 35*a* and 35*b*, side edges on the sides receiving the compression portions 42*a* and 42*b* are sloped guide portions 37*a* and 37*b* so as to be securely compressed by the compressing portions 42*a* and 42*b* of the insertion guide member 41 on the side of the thermal transfer printer apparatus. In the non-reversing mechanism 31 thus configured, the pair of resilient engagement pieces 33*a* and 33*b* are provided integral with the upper shell 21, and even separately provided members such as the leaf spring used in the previously proposed reverse rotation mechanism are not necessary, so that reduction in the number of components/parts can be accomplished.

As shown in FIG. 1, the side of the other end portion of the cartridge body 5, that is, the side where the driving openings 14 of the supply and take-up spools 3 and 4 are exposed from the driving openings 28*a* and 28*b* is used as an insertion end. Thereby, the ink ribbon cartridge 1, which is configured as described above, is inserted into the thermal transfer printer apparatus along the direction of the arrow X (shown in FIG. 1). Then, as shown in FIG. 5, the ink ribbon cartridge 1 is guided by the insertion guide member 41 of the thermal transfer printer apparatus and is inserted into an installation portion. Upon installation of the ink ribbon cartridge 1 in the installation portion, the drive shafts on the side of the thermal transfer printer apparatus are engaged with the driving openings 14 of the supply and take-up spools 3 and 4. In this event, the supply and take-up spools 3 and 4 are compressed by spring forces of the drive shafts on the side of the thermal transfer printer apparatus onto a base plane of the sidewall 27, whereby the backlash is eliminated, and positioning in the axial direction is made.

Concurrently, the compression portions 42*a* and 42*b* of the insertion guide member 41 of the thermal transfer printer apparatus shown in FIG. 5 compresses the compressed portions 35*a* and 35*b* of the resilient engagement pieces 33*a* and 33*b* protruding from the through-holes 36*a* and 36*b* of the lower shell 22. In this event, since the compressed portions 35*a* and 35*b* include the sloped guide portions 37*a* and 37b, the compressed portions 35*a* and 35*b* are securely compressed by the compressing portions 42*a* and 42*b* of the insertion guide member 41. Then, with the base end portions being used as resilience origins, the resilient engagement pieces 33*a* and 33*b* with the ratchet portions 34*a* and 34*b* held in engagement with the ratchet gear 13, 13 resiliently displace along the A direction (shown in FIG. 5). Thereby, the engagement between the ratchet gears 13 and 13 and the ratchet portions 34*a* and 34*b* are released. This makes the supply and take-up spools 3 and 4 smoothly rotatable with the drive shafts of the thermal transfer printer apparatus.

In conjunction with rotation of the supply and take-up spools 3 and 4 with the drive shafts of the thermal transfer printer apparatus along the B direction, the ink ribbon 2 travels along the same direction. In addition, the thermal head of the thermal transfer printer apparatus proceeds into the opening portion 29 of the cartridge body 5 and applies thermal energy to the ink ribbon 2 extended to the opening portion 29, thereby to thermally transfer the dies onto the printing paper. During travel of the ink ribbon 2, since the ratchet portions 34*a* and 34*b* are in non-engagement with the ratchet gears 13, such that the resilient engagement pieces 33*a* and 33*b* are able to prevent operation noise.

Further, as shown in FIG. 5, in the ink ribbon cartridge 1, during a non-usage event such as a storage or transportation event, the resilient engagement pieces 33*a* and 33*b* are urged along the A direction, and the ratchet portions 34*a* and 34*b* are in engagement with the ratchet gears 13.

It is now assumed that, in the above-described state, a rotational force in an arrowed C direction (shown in FIG. 5) identical to an arrowed B direction (shown in FIG. 5) for causing traveling of the ink ribbon 2 is applied by vibration or the like. In this case, a force in the direction of engagement of the ratchet portion 34*a* of the resilient engagement piece 33*a* with the ratchet gear 13 is applied. This makes it possible to prevent the supply spool 3 from rotating along the C direction. As such, in such an event that an unused ink ribbon 2 installed in the printer apparatus is not used, it is possible to prevent the ink ribbon 2 from extending to the opening portion 29. As another case, it is now assumed that a rotational force for rotating the supply spool 3 along an arrowed D direction (shown in FIG. 5) is applied by vibration or the like. In this case, the ratchet portion 34*a* of the resilient engagement piece 33*a* rides over the ratchet gear 13, and the supply spool 3 rotates along the D direction.

When a rotational force in an arrowed E direction (shown in FIG. 5) identical to the B direction for taking-up the ink ribbon 2 is applied by vibration or the like, the ratchet portion 34*b* of the resilient engagement piece 33*b* rides over the ratchet gear 13, whereby take-up spool 4 rotates along the E direction. However, when a rotational force in an arrowed F direction (shown in FIG. 5) is applied, a force in the direction of engagement of the ratchet portion 34*b* of the resilient engagement piece 33*b* with the ratchet gear 13 is applied, thereby making it possible to prevent the supply spool 4 from rotating along the F direction. As such, in the event that a spent ink ribbon 2 mounted is not used in the printer apparatus, it is possible to prevent the ink ribbon 2 from extending to the opening portion 29. Consequently, it is possible to prevent printed information from leaking from the spent ink ribbon 2.

More specifically, the non-reversing mechanism 31 inhibits rotation in the C direction for feeding the ink ribbon 2 to the opening portion 29, and inhibits rotation in the F direction, which is reverse direction of the winding direction of the ink ribbon 2 of the take-up spool 4. Thereby, also slack of the ink ribbon 2 can be prevented.

It should be understood by those skilled in the art that various modifications, combinations, sub-combinations and alterations may occur depending on design requirements and other factors insofar as they are within the scope of the appended claims or the equivalents thereof.

What is claimed is:

1. An ink ribbon cartridge, comprising:

a cartridge body;

a pair of spools in the cartridge body located apart from each other and capable of being rotated the pair of spools being a supply spool and a take-up spool;

an ink ribbon wound about each of the spools;

a ratchet gear located at an end of each one of the spools;

a pair of engagement pieces coupled to each other, each engagement piece associated with one of the spools;

a ratchet portion located at an end of each of the engagement pieces effective to engage and disengage the ratchet gear on each of the spools such that when the spools are engaged they are rotatable independently of each other;

at least one compressible portion attached to each of the engagement pieces; and a through-hole in the ink ribbon cartridge associated with each compressible portion and through which each compressible portion can protrude from and be compressed within wherein, the compressible portions when compressed are effective to disengage the ratchet gears on the spools such that the spools become rotatable in the cartridge body.

2. An ink ribbon cartridge according to claim 1 wherein, the ratchet portion associated with the take-up spool engages the ratchet gear on the take-up spool before the supply spool is about to rotate along a supply direction for feeding the ink ribbon, and the ratchet portion associated with the supply spool engages the ratchet gear on the supply spool engages before the take-up spool is about to rotate in a reverse direction with respect to a take-up direction of the ink ribbon.

3. An ink ribbon cartridge according to claim 1, wherein a compressing portion located outside of the cartridge body compresses the compressing portions.

4. An ink ribbon cartridge according to claim 1, wherein a sloped guide portion is located at the end of each compressing portion.

5. An ink ribbon cartridge according to claim 1, wherein:

a driving opening is located on each of the spools, the driving opening effective to engage with a drive shaft; and the cartridge body includes a base wall that is abutted by an end side opposite to the driving opening of each of the pair of spools effective to define a position perpendicular to a travel direction of the ink ribbon when the ink ribbon cartridge is installed in a thermal transfer printer apparatus and when the drive shaft is engaged with the driving opening.

* * * * *